United States Patent [19]

Blowsky et al.

[11] 4,211,404

[45] Jul. 8, 1980

[54] TELESCOPING PHYSICAL EXERCISING DEVICE

[76] Inventors: Frank C. Blowsky, 46-16 195th St., New York, N.Y. 11358; Kenneth B. Glickman, 11 Waverly Pl., New York, N.Y. 10003

[21] Appl. No.: 905,235

[22] Filed: May 12, 1978

[51] Int. Cl.[2] ..... A63B 21/00

[52] U.S. Cl. ..... 272/141

[58] Field of Search ..... 272/134–137, 272/141, 130; 273/69, 80 D; 73/379, 380

[56] References Cited

U.S. PATENT DOCUMENTS

| | | | |
|---|---|---|---|
| 1,023,756 | 4/1912 | Pons | 73/380 X |
| 2,106,994 | 2/1938 | Chapman | 272/137 |
| 2,132,862 | 10/1938 | Pilates | 272/137 |
| 2,218,825 | 10/1940 | Guillou | 273/69 X |
| 2,926,911 | 3/1960 | Reichel | 272/141 X |
| 3,003,764 | 10/1961 | Yovanovitch | 272/141 X |
| 3,457,786 | 7/1969 | Trent | 272/141 X |
| 3,759,514 | 9/1973 | Cox | 272/141 X |
| 4,026,548 | 5/1977 | Birdwell | 272/136 |

FOREIGN PATENT DOCUMENTS

| | | | |
|---|---|---|---|
| 2051786 | 5/1972 | Fed. Rep. of Germany | 272/141 |
| 9899 | of 1909 | United Kingdom | 272/141 |

*Primary Examiner*—Richard J. Apley
*Attorney, Agent, or Firm*—Milton Wolson

[57] ABSTRACT

A physical exercising device having a design which permits it to be manufactured in a small, compact configuration. The exercising device includes means for enabling increased compression of a compression spring located in the exercising device.

4 Claims, 1 Drawing Figure

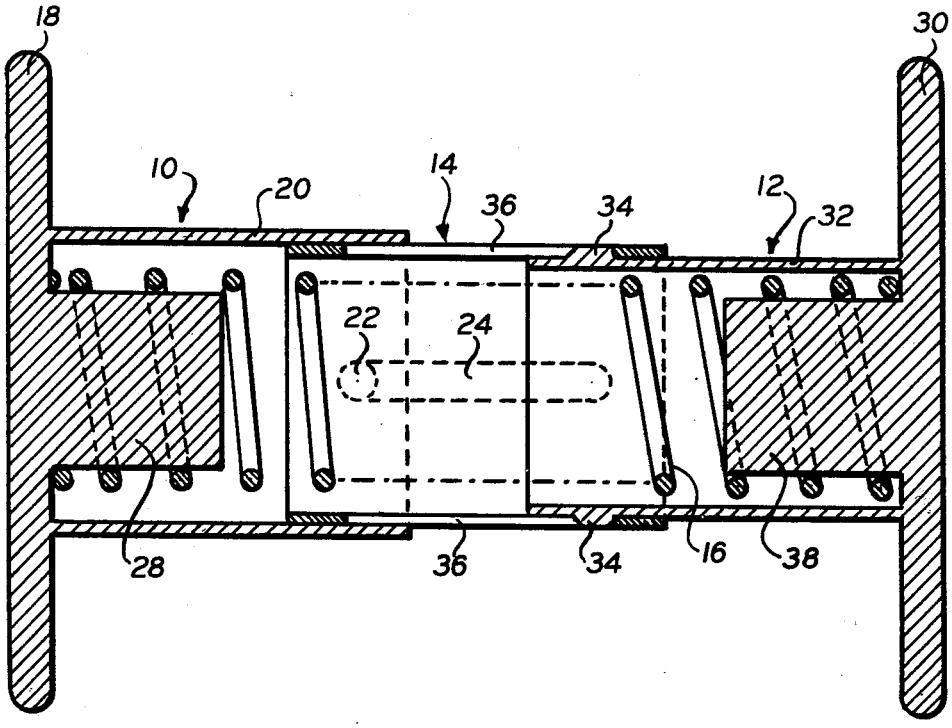
18
30
10
20
14
36
34
12
32
22
24
28
36
34
16
38

TELESCOPING PHYSICAL EXERCISING DEVICE

CROSS-REFERENCES TO RELATED APPLICATIONS

There are no previously filed pending patent applications related to the present application. A patent application entitled "Physical Exercising Device," in which the applicants are Frank Blowsky, Kenneth Glickman and Alan Iscoe, is being filed on the same date as the present application.

BACKGROUND OF THE INVENTION (1) Field of the Invention

The field of this invention is physical exercising devices.

(2) Description of the Prior Art

It is known in the prior art that physical exercises may be performed by means of a device in which the exerciser exerts a force which causes compression of a compression spring in the exercising device. Such a device is disclosed in U.S. Pat. No. 2,106,994, and U.S. Pat. No. 2,132,862. In exercising devices of this type the greater the distance that the exerciser causes the compression spring to be compressed, the greater will be the amount of exercise performed. Therefore it is desirable to provide such exercising devices with means which permit increased compression of the compression spring.

In prior art devices such as disclosed in the '994 patent and the '862 patent, the extent to which the compression spring may be compressed is limited by the distance that the inner or outer telescopic tube is permitted to move.

For example, in the exercising device disclosed in the '994 patent, if the length of the inner telescopic tube 1 is greater than the length of the outer telescopic tube 2, then the extent to which compression spring 12 may be compressed is limited by the distance that the inner telescopic tube 1 moves before it abuts against an interior portion, spigot 4, of outer telescopic tube 2. On the other hand should the length of outer telescopic tube 2 be greater than the length of inner telescopic tube 1, then the extent to which compression spring 12 may be compressed is limited by the distance that the outer telescopic tube 2 moves before it abuts against an interior portion, plate 7. If however, the length of the inner telescopic tube 1 is the same as the length of outer telescopic tube 2 then the extent to which compression spring 12 may be compressed is limited by the distance, which will be the same, that the inner tube 1 and the outer tube 2 move before they abut interior portions 4 and 7, respectively.

Similarly, in the exercising device disclosed in the '862 patent, if the length of the inner telescopic tube 20 is greater then the length of the outer telescopic tube 15, then the extent to which compression spring 22 may be compressed is limited by the distance that the inner telescopic tube 20 moves before it abuts against an interior portion of container block 26 of outer telescopic tube 15. Conversely, should the length of outer telescopic tube 15 be greater than the length of inner telescopic tube 20, then the extent to which compression spring 22 may be compressed is limited by the distance that the outer telescopic tube 15 moves before it abuts against an interior portion of flanged receiver 25. If the length of inner telescopic tube 20 is the same as the length of outer telescopic tube 15 then the extent to which compression spring 22 may be compressed is limited by the distance, which will be the same, that the inner tube 20 and the outer tube 15 move before they abut the interior portions of container block 26 and flanged receiver 25, respectively.

SUMMARY OF THE INVENTION

There is at the present time a great interest in physical fitness and the use of physical exercising devices to achieve such fitness. Physical exercises are performed at home, in the office and wherever an opportunity occurs. For this reason it is highly desirable to provide a small, compact exercising device which may be readily transported.

An object of the present invention is to provide such a small, compact exercising device wherein means are provided for increasing the distance that the inner and outer telescopic tube members are permitted to move, and thus increasing the extent to which a compression spring may be compressed.

BRIEF DESCRIPTION OF THE DRAWING

In the accompanying drawing, there is illustrated a longitudinal section of an embodiment of the present invention.

DESCRIPTION OF THE PREFERRED EMBODIMENT

There is shown in the drawing, an exercising device having a housing comprising an outer tube member 10, an inner tube member 12 and an intermediate member 14 which is also in the form of a tube member. A compression spring 16 is supported in the housing in a manner described below.

The outer tube member 10 includes a handle member 18 which may be in the form of a circular disc. An outer tube cover portion 20 shown as a cylindrical member is integral with the inner face of handle member 18. Two stop members 22 (only one of which is shown in the drawing) extend from the interior surface of outer tube cover portion 20 into opening 24 (only one of which is illustrated in the drawing), in intermediate member 14.

A spring support 28 is shown integral with the interior face of handle member 18. The outer diameter of spring support 28 is slightly smaller than the inner diameter of compression spring 16, so that an end of compression spring 16 is journalled around and supported by spring support 28 in such a manner that compression spring 16 biases outer tube member 10 to the left.

Inner tube member 12 is generally similar to outer tube member 10 and comprises a handle member 30 which may be in the form of a circular disc. An inner tube cover portion 32 shown as a cylindrical member is integral with the inner face of handle member 30. In the illustrated embodiment cover portion 32 is shown to be the same length as cover portion 20. Two tab members 34 extend from the exterior surface of inner tube cover portion into openings 36 in intermediate member 14.

A spring support 38 is shown integral with the interior face of handle member 30. The outer diameter of spring support 38 is slightly smaller than the inner diameter of compression spring 16, so that an end of compression spring 16 is journalled around and supported by spring support 38, in such a manner that compression spring 16 biases inner tube member 12 to the right.

When the exercising device is at rest compression spring 16 biases outer tube member 10 to the left and inner tube member 12 to the right. The leftward movement of outer tube member 10 is limited by engagement of two stop members 22 of the outer tube member 10 with the left hand ends of openings 24 in intermediate member 14. The rightward movement of inner tube member 12 is limited by engagement of the tab members 34 of the inner tube member 12 with the right-hand ends of openings 36 in intermediate member 14. It is preferable that the two stop members 22 engage the left-hand ends of openings 24 at the same time that the two tab members 34 engage the right-hand ends of opening 36.

When exercises are to be performed with the exercising device, the exerciser causes the outer tube member 10 and the inner tube member 12 to move with respect to each other. This may be accomplished for example, by the exerciser pushing handle member 18 and handle member 30 toward each other.

As outer tube member 10 and inner tube member 12 are caused to move with respect to each other it will be seen that outer tube member 10 slides over intermediate member 14 and inner tube member 12 slides inside of intermediate member 14.

Outer tube member 10 will move over intermediate member 14 until it abuts an interior portion of handle member 30. Thus it will be seen that outer tube member 10 of the present invention is permitted to move a greater distance (i.e. it will move over the intermediate member 14) than the analogous outer tube members of the prior art; and accordingly the extent to which compression spring 16 of the present invention may be compressed is greater than the extent to which similar prior art compression springs may be compressed.

Similarly inner tube member 12 of the present invention will move within intermediate member 14 until it abuts an interior portion of handle member 18. In this manner inner tube member 12 of the present invention is permitted to move a greater distance (i.e. it will move within intermediate member 14) than the analogous inner tube members of the prior art; and accordingly the extent to which compression spring 16 of the present invention may be compressed is greater than the extent to which the similar prior art compression springs may be compressed.

As earlier explained, the greater the distance that the exerciser may cause the compression spring to be compressed, the greater will be the amount of exercise performed. Therefore the present invention which permits increased compression of the compression spring will allow the exerciser to perform a greater amount of exercise.

When the cover portion 32 and the cover portion 20 are of the same length as in the illustrated embodiment then the rightward movement of outer tube member 10 over intermediate member 14 will be limited by abutment of cover portion 20 with the inner face of handle member 30; and the leftward movement of inner tube member 12 inside of intermediate member 14 will be limited by abutment of cover portion 32 with the inner face of handle member 18.

If the cover portion 32 is longer than the cover portion 20, then both the rightward movement of outer tube member 10 over intermediate member 14 and the leftward movement of inner tube member 12 inside of intermediate member 14 will be limited by abutment of cover portion 32 with the inner face of handle member 18.

Conversely, if the cover portion 20 is longer than the cover portion 32, then both the rightward movement of outer tube 10 over intermediate member 14 and the leftward movement of inner tube member 12 inside of intermediate 14 will be limited by abutment of cover portion 20 with the inner face of handle member 30.

Although the present invention has been described and illustrated in connection with preferred embodiments, it is to be understood that modifications and variations may be resorted to without departing from the spirit of the invention, as those skilled in this art will readily understand. Such modifications and variations are considered to be within the preview and scope of the present invention as defined by the appended claims.

Having described the present invention, I claim:

1. A physical exercising device comprising: an outer member having a handle portion; an inner member having a handle portion; a compression spring connected between the outer member and the inner member and in cooperative relation with the outer member and the inner member whereby the compression spring will be compressed when the outer member and inner member are caused to be moved with respect to each other; an intermediate member located between the outer member and the inner member which is of smaller cross section than the outer member and of larger cross section than the inner member; and said outer member having means which cooperate with the intermediate member and said inner member having means which cooperate with the intermediate member so that the outer member may slide over the intermediate member and the inner member may slide within the intermediate member.

2. A physical exercising device as set forth in claim 1 wherein the outer member, the inner member and the intermediate member are all tubular shaped.

3. A physical exercising device as set forth in claim 1 wherein the outer tube member and the inner tube member each include spring supports for supporting the compression spring.

4. A physical exercising device as set forth in claim 3 wherein the ends of the compression spring are journalled over the spring supports.

* * * * *